US009468840B2

(12) United States Patent
Nally

(10) Patent No.: US 9,468,840 B2
(45) Date of Patent: Oct. 18, 2016

(54) TWO SIDED TABLE GAME WITH ROTATABLE LEGS

(71) Applicant: Eastpoint Sports Ltd., LLC, Whippany, NJ (US)

(72) Inventor: Michael Nally, Whippany, NJ (US)

(73) Assignee: Eastpoint Sports Ltd., LLC, Succasunna, NJ (US)

( * ) Notice: Subject to any disclaimer, the term of this patent is extended or adjusted under 35 U.S.C. 154(b) by 0 days.

(21) Appl. No.: 14/502,590

(22) Filed: Sep. 30, 2014

(65) Prior Publication Data

US 2015/0091249 A1 Apr. 2, 2015

Related U.S. Application Data

(60) Provisional application No. 61/884,793, filed on Sep. 30, 2013.

(51) Int. Cl.

| | |
|---|---|
| ***A63F 7/06*** | (2006.01) |
| ***A63F 7/36*** | (2006.01) |
| *A63F 7/30* | (2006.01) |
| *A63F 7/24* | (2006.01) |

(52) U.S. Cl.

CPC ..... *A63F 7/06* (2013.01); *A63F 7/0612* (2013.01); *A63F 7/0616* (2013.01); *A63F 7/0632* (2013.01); *A63F 7/0652* (2013.01); *A63F 7/36* (2013.01); *A63F 7/249* (2013.01); *A63F 7/305* (2013.01); *A63F 2007/3611* (2013.01); *A63F 2007/3685* (2013.01); *A63F 2007/3696* (2013.01)

(58) Field of Classification Search

CPC ..... A63F 7/06; A63F 7/0005; A63F 7/0612; A63F 7/0616; A63F 7/0652; A63F 7/305; A63F 7/36; A63F 7/0632; A63F 7/249; A63F 2007/3611; A63F 2007/3685; A63F 2007/3696; A47B 37/00; A47B 3/06

USPC ..... 273/108–108.57, 407, 126 R, 126 A, 273/127 D; 297/121, 283.1; 108/11, 12, 13; 473/16

See application file for complete search history.

(56) References Cited

U.S. PATENT DOCUMENTS

| | | | | | |
|---|---|---|---|---|---|
| 1,346,782 | A | * | 7/1920 | Gehring | A63F 7/0608 273/108.31 |
| 1,603,717 | A | * | 10/1926 | Rubino | A63F 7/0668 273/108.4 |
| 2,841,398 | A | * | 7/1958 | Conner | A63F 7/06 124/44.7 |
| 3,785,552 | A | * | 1/1974 | Payne, Jr. | A63F 7/22 116/223 |
| 4,305,581 | A | * | 12/1981 | Neuharth | A63D 15/04 473/15 |
| 4,310,159 | A | * | 1/1982 | Wing | A63F 7/066 273/108 |
| 4,733,867 | A | * | 3/1988 | Kemp | A63F 7/0668 273/108.5 |
| 4,872,410 | A | * | 10/1989 | Lilly | A47B 23/001 108/13 |
| 4,872,679 | A | | 10/1989 | Bohaski et al. | |
| 5,342,050 | A | | 8/1994 | Thompson | |
| 5,556,094 | A | | 9/1996 | Shiledar Baxi | |
| 5,630,760 | A | | 5/1997 | Brown et al. | |

(Continued)

*Primary Examiner* — Sebastiano Passanti
(74) *Attorney, Agent, or Firm* — Thomas J. Oppold; Larkin Hoffman Daly & Lindgren, Ltd.

(57) ABSTRACT

A two-sided table game has a game board having a first game playing surface on a first side and a second game playing surface on a second side. Rotatable leg assemblies support the game board above a support surface. When it is desired to play the game on the second side, the rotatable leg assemblies are rotated and the game table is flipped or rotated so that the second game playing surface faces up.

10 Claims, 7 Drawing Sheets

(56) References Cited

U.S. PATENT DOCUMENTS

| | | | | |
|---|---|---|---|---|
| D446,250 | S | 8/2001 | Quiroga et al. | |
| 6,345,820 | B1 | 2/2002 | Zucchi et al. | |
| 6,347,797 | B1 * | 2/2002 | Tsai | A63D 15/04 273/309 |
| 6,419,224 | B1 | 7/2002 | Tsai | |
| 6,764,409 | B1 * | 7/2004 | Voden | A63D 15/04 273/126 A |
| 7,389,987 | B1 | 6/2008 | Paukert | |
| 8,267,804 | B1 * | 9/2012 | Tsai | A63D 15/04 273/126 A |
| 8,505,921 | B2 * | 8/2013 | Amodt | F41J 1/10 273/407 |
| 8,528,489 | B2 * | 9/2013 | Roy | A47B 3/08 108/125 |
| 2004/0164488 | A1 | 8/2004 | Fitzgerald | |
| 2007/0155519 | A1 * | 7/2007 | Panzica | A63D 15/04 473/1 |
| 2007/0216101 | A1 | 9/2007 | Padilla | |
| 2013/0053191 | A1 | 2/2013 | Lu | |

* cited by examiner

TWO SIDED TABLE GAME WITH ROTATABLE LEGS

BACKGROUND

Table games with miniature game pieces for playing a simulated sport such as football, basketball, soccer and hockey, for example, or for playing a miniaturized version of a larger game such as shuffleboard, table tennis, bowling and billiards, for example, are well known. However, heretofore, such table games required a separate game table for each simulated sport or miniaturized version of a larger game.

Accordingly, it is desirable to provide a table game with two game playing surfaces on opposite sides which can be flipped depending on the desired game to be played.

DESCRIPTION

Figure 1:
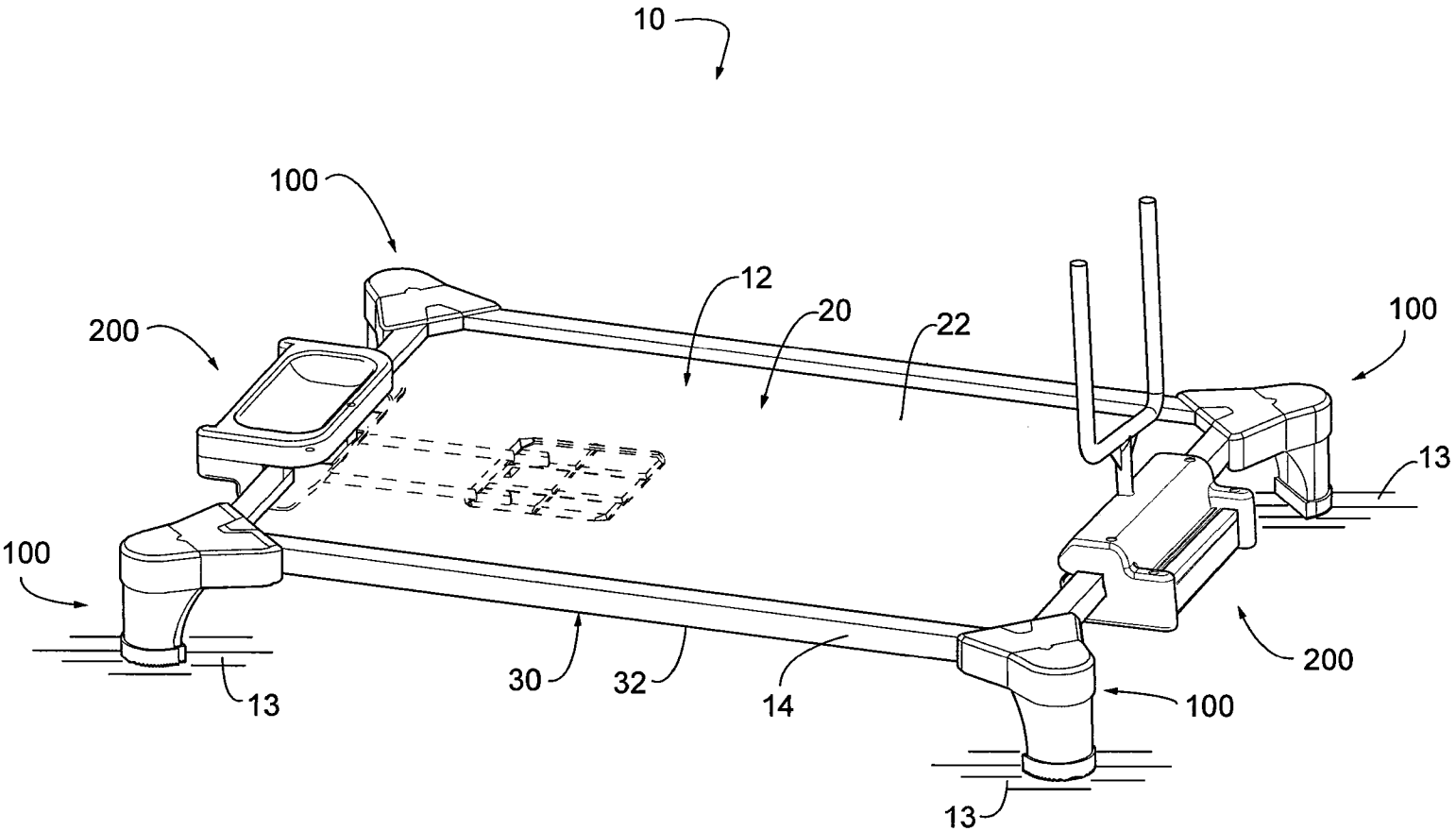
FIG. 1 is a perspective view of an embodiment of a table game with a football game playing surface facing up and a basketball game playing surface facing down.

Referring to the drawings wherein like reference numerals designate the same or corresponding parts throughout the several views, FIG. 1 is a perspective view of an embodiment of a table game 10. The table game 10 includes a game board 12, rotatable leg assemblies 100 and one or more goal assemblies 200. The rotatable leg assemblies 100 support the game board 12 above a support surface 13 a sufficient distance for clearance of the goal assemblies 200. The game board 12 includes a first side 20 having a first game playing surface 22 and a second side 30 having a second game playing surface 32.

Figure 2:
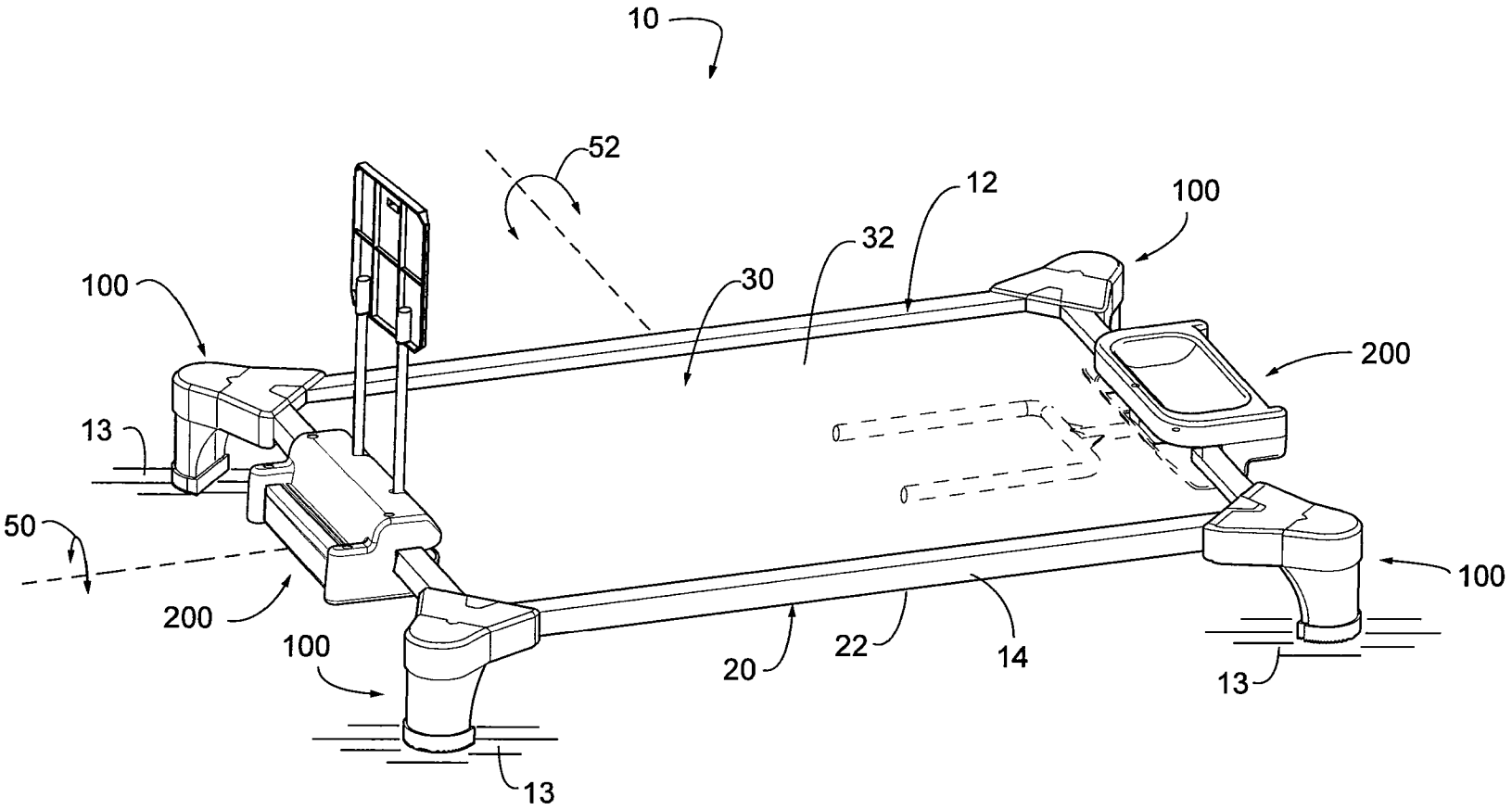
FIG. 2 is a perspective view of the table game of FIG. 1 with the basketball game playing surface facing up and the football game playing surface facing down.

FIG. 2 is a perspective view of the same table game 10 of FIG. 1 after the rotatable leg assemblies 100 have been rotated (discussed later) and the game table 10 has flipped or rotated about any longitudinal axis 50 or lateral axis 52 (discussed later) such that the second side 30 with the second game playing surface 32 is now facing up and the first side 20 with the first game playing surface 22 is facing down toward the support surface 13.

Figure 3:
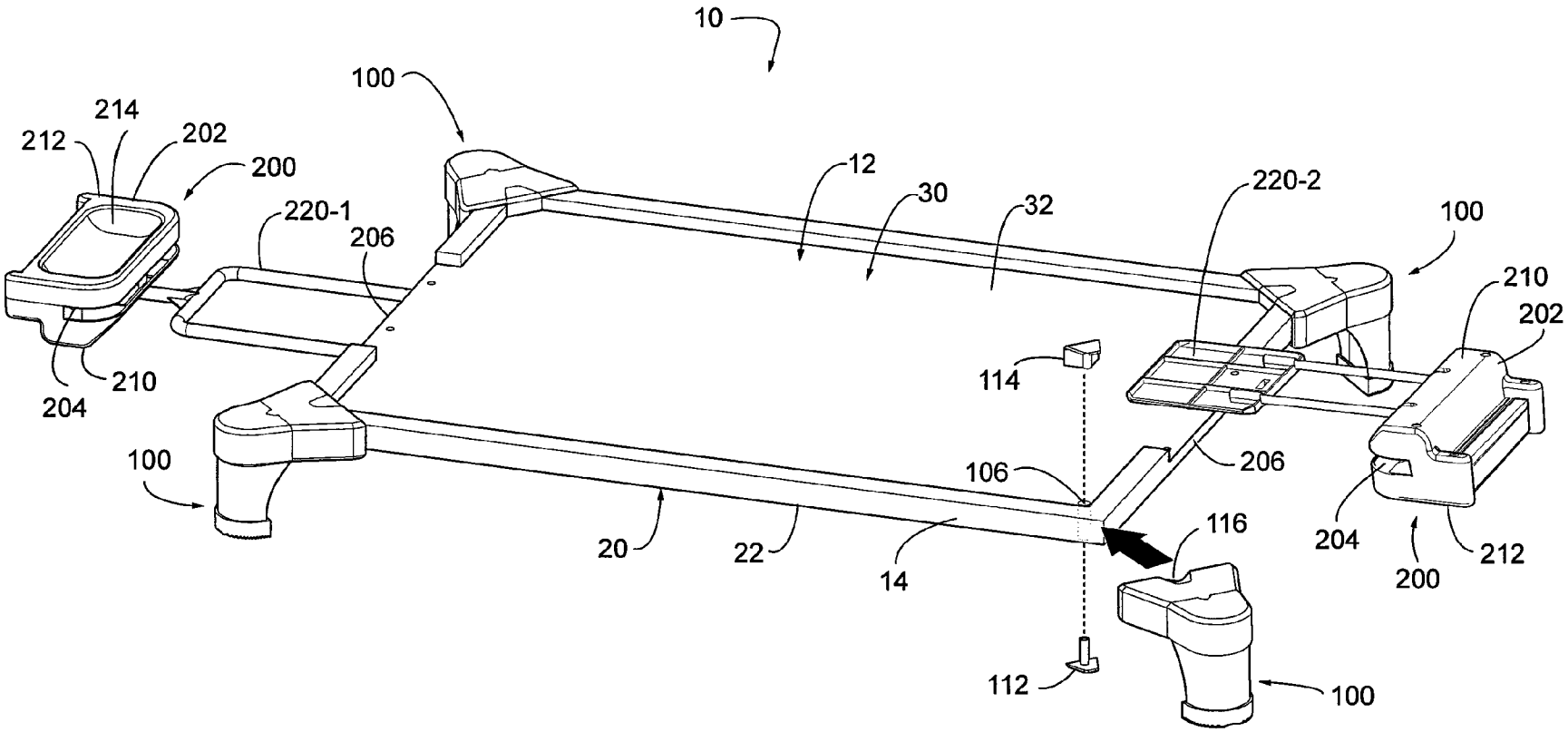
FIG. 3 is a partially exploded perspective view of the table game of FIG. 1.
Figure 4:
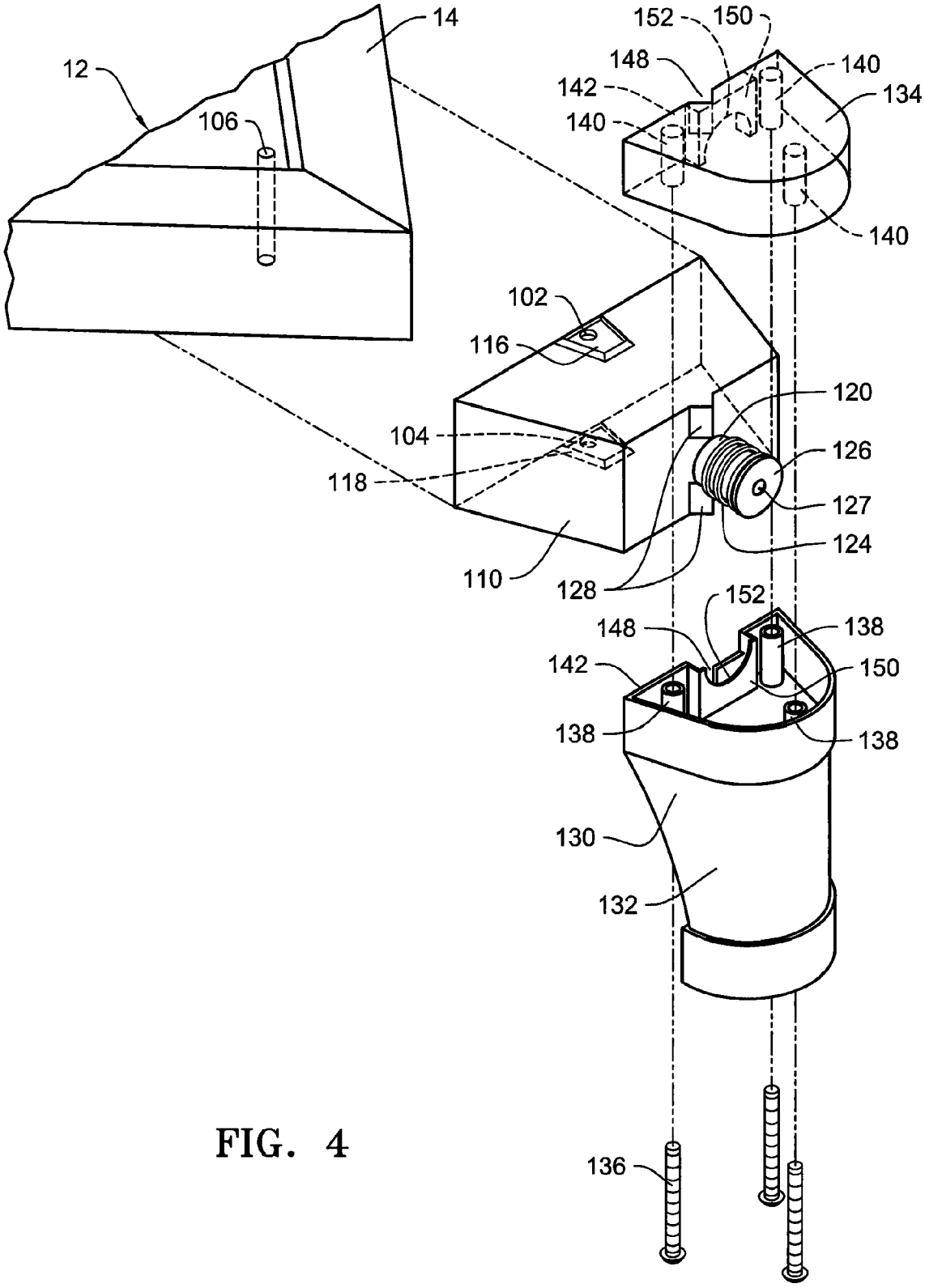
FIG. 4 is an exploded perspective view of the rotatable leg assembly of the table game of FIG. 1.

FIG. 3 is a partially exploded perspective view of the table game of FIG. 1. The game board 12 may include a peripheral frame 14 to provide structural rigidity to the game board 12 and may be used for mounting the rotatable leg assemblies 100 to the game board 12 (discussed later). The frame 14 may also serve to retain the game components on the game playing surfaces 22, 32.

The game table 10 may comprise any combination of game playing surfaces 22, 32 on the first and second sides

20, 30 of the game board 12. For example, the game playing surfaces 22, 32 may include, without limitation, miniaturized simulated sports such football, basketball, soccer and hockey and/or miniaturized versions of other games, including for example, without limitation, table tennis, hover hockey, block hockey and shuffleboard.

For purposes of this patent application, the table game 10 is shown and described herein as having a football game playing surface 22 on the first side 20 of the game board 12 and a basketball game playing surface 32 on the second side 30 of the game board 12. An example of a more detailed embodiment of the football game playing surface 22 is shown in plan view in FIG. 6 and an example of a more detailed embodiment of the basketball game playing surface 32 is shown in plan view in FIG. 7. As previously stated, however, it should be appreciated that the first and second game playing surfaces 22, 32 may comprise any combination of the games listed above or any other desired games.

Figure 6:
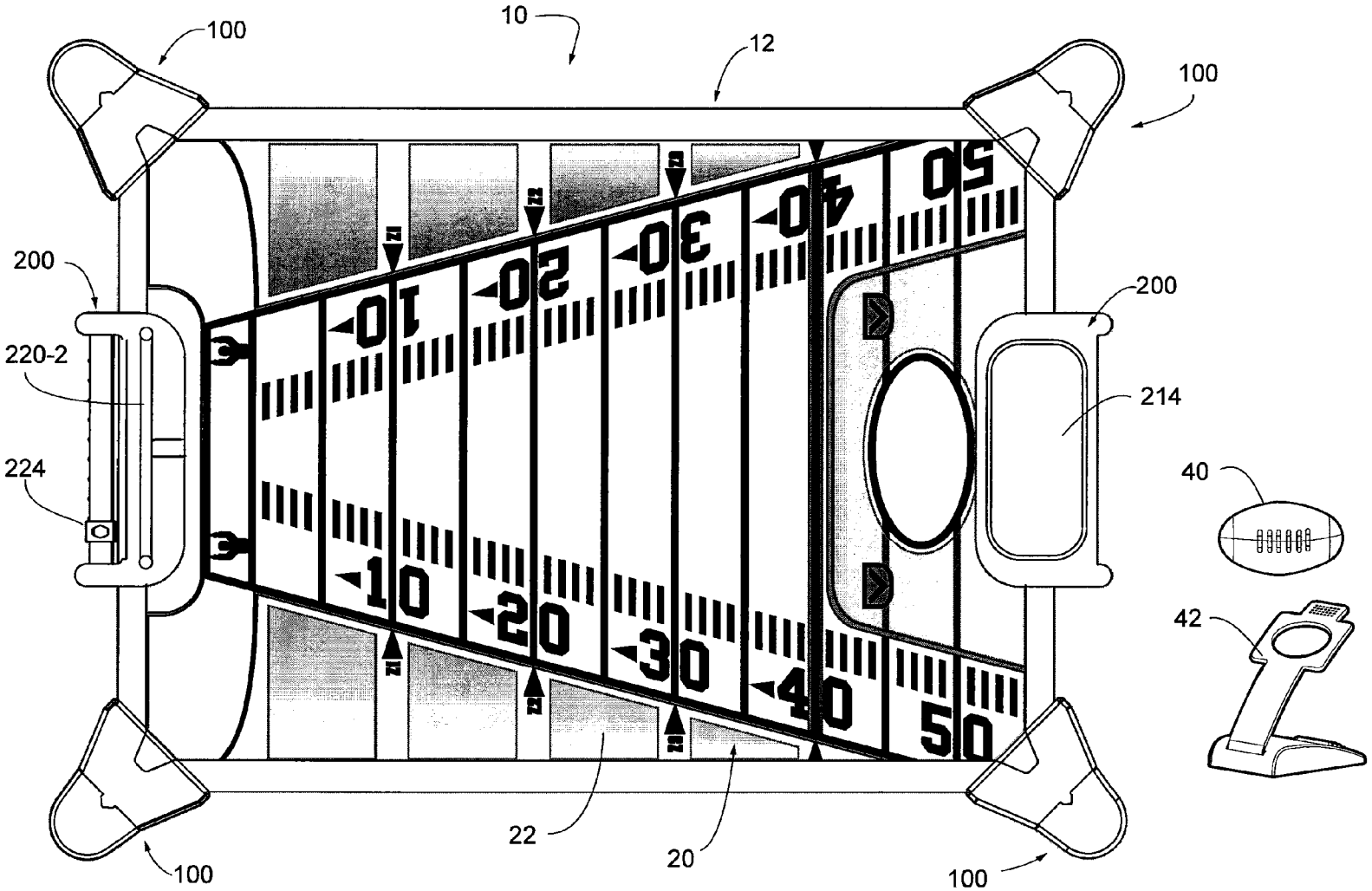
FIG. 6 is a top plan view of an embodiment of the football game playing surface of the game table of FIG. 1 and illustrating an embodiment of the football launcher.
Figure 7:
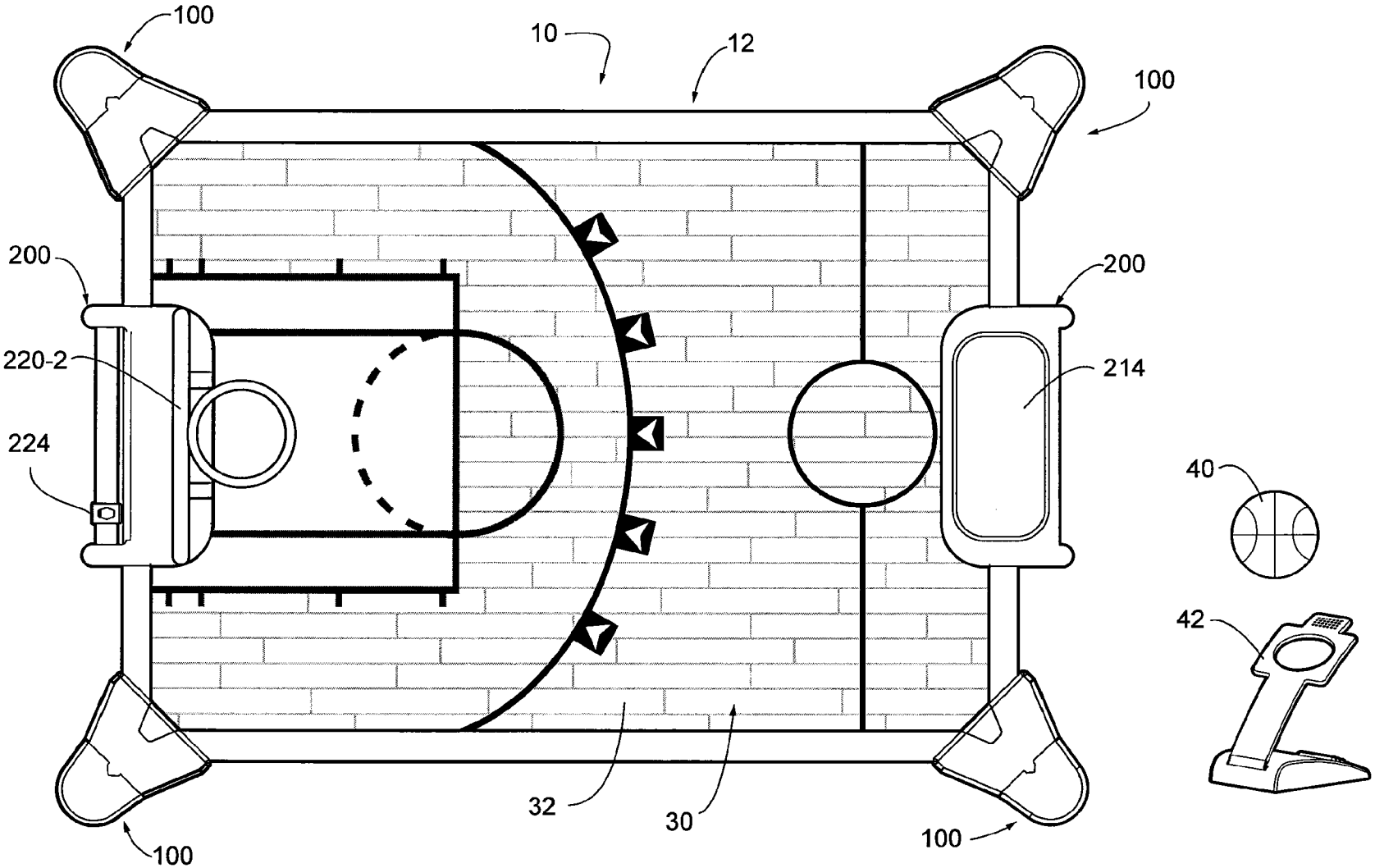
FIG. 7 is a top plan view of an embodiment of the basketball game playing surface of the game table of FIG. 1 and illustrating an embodiment of the basketball launcher.

The game table 10 may include various game components depending on the games comprising the game table. For example the game table 10 may include miniaturized balls 40 and launchers 42 (as known in the art) for launching or shooting the miniaturized balls toward the goal assembly 200. As shown in FIGS. 1 and 6, for example, the miniaturized ball 40 is a miniature football and the launcher 42 is positioned at different locations on the game playing surface 22 for shooting the miniature football through the uprights of the goal post 220-1 to simulate kicking a field goal. As shown in FIGS. 2 and 7, for example, the miniaturized ball 40 is a miniature basketball and the launcher 42 is positioned at different locations on the game playing surface 32 for shooting the miniature basketball through the hoop on the backboard 220-2.

Referring to FIGS. 3, 4 and 5A-5C, the rotatable leg assembly 100 includes a leg bracket 110 and a rotatable leg member 130. The leg bracket 110 is configured to receive a corner 16 of the game board 12. The leg bracket 110 is secured to the corner 16 of the game board 12 by a pin 112 which extends through holes 102, 104 in the top and bottom of the leg bracket 110 and through an aligned hole 106 through the game board 12. A plug 114 receives the end of the pin 112. The pin 111 and plug 114 are retained within a complimentary shaped recess 116, 118 in the top and bottom of the leg bracket 110.

A shaft 120 projects outwardly from an outer face 122 of the leg bracket 110. A coil spring 124 is retained on the shaft 120 by a cap 126 secured by a threaded connector 127. The outer face 122 includes outwardly projecting locking tabs 128.

The rotatable leg member 130 includes a leg portion 132 and a leg cap 134 which are secure together by threaded connectors 136 which extend between aligned posts 138, 140 in the leg portion 132 and leg cap 134. When secured together, the leg portion 132 and leg cap 134 form an inner face 142 which matingly aligns with the outer face 122 of the leg bracket 110. The inner face 142 includes a locking recess 148 which receives the outwardly projecting locking tabs 128 of the leg bracket 110. The leg portion 132 and the leg cap 134 also include an inner flange 150, 152 each having a semicircular cutout 154 sized to receive the shaft 120. When the leg portion 132 and leg cap 134 are secured together by the threaded connectors 136, the semicircular cutout within the flanges 150, 152 surround the shaft 120 and serve as an abutment to the inner end of the coil spring 124. Thus, the coil spring 124 biases the leg member 130 toward the leg bracket 110 and the locking tabs 128 received within the locking recesses 148 prevent the leg member 130 from rotating with respect to the leg bracket 110.

Figure 5A:
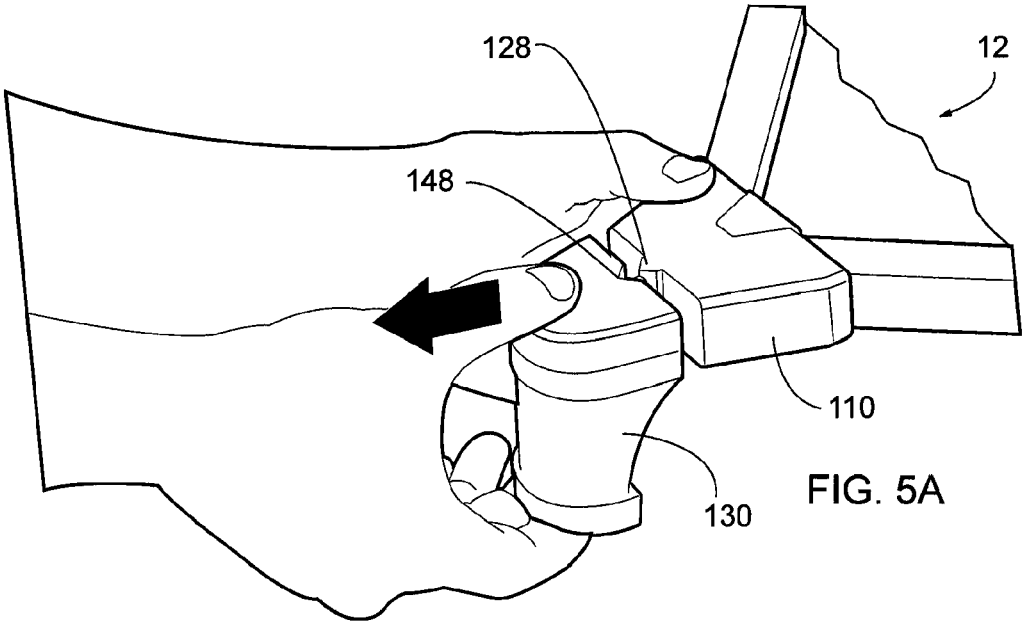
FIGS. 5A-5C illustrate the steps of rotating one of the rotatable leg assemblies of the table game of FIG. 1.
Figure 5B:
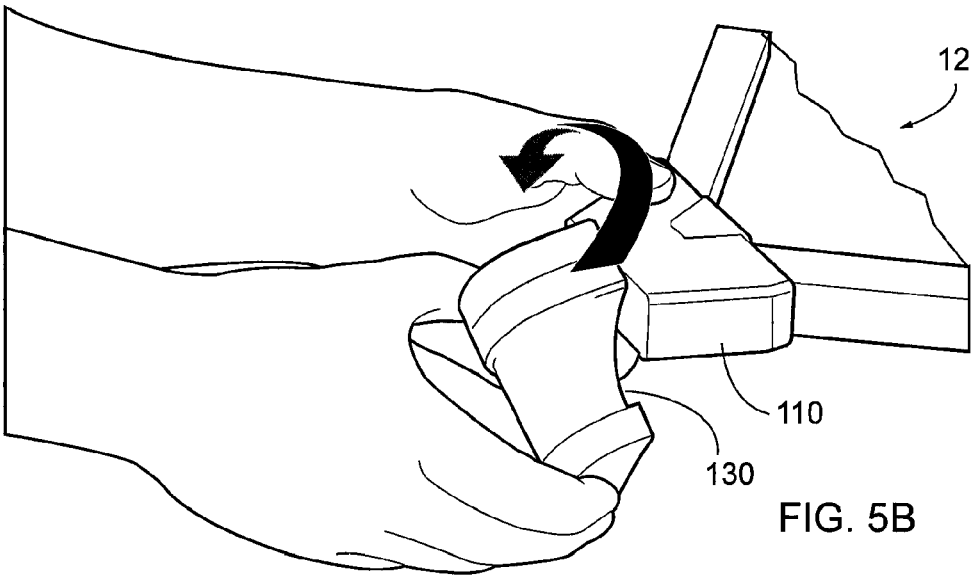
Figure 5C:
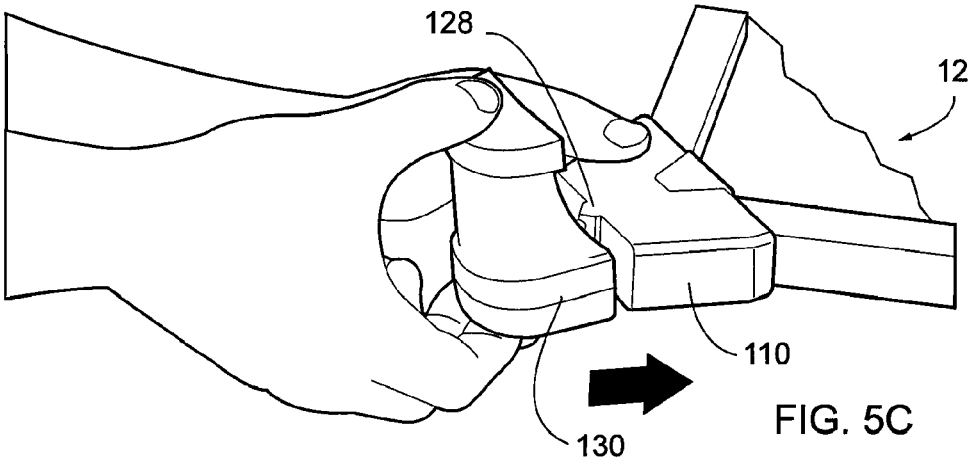

To rotate the leg member 130 with respect to the leg bracket 110, the leg member 130 is pulled outwardly as illustrated in FIG. 5A to disengage the locking tabs 128 from the locking recesses 148 and causing the coil spring 124 to compress between the cap 134 and the inner flanges 150, 152 surrounding the shaft 120. The leg member 130 is then rotated with respect to the leg bracket 110 as shown in FIG. 5B. When the leg member 130 is fully inverted or rotated 180 degrees from its original position as illustrated in FIG. 5C so that the locking tabs 128 are again aligned with the locking recesses 148, the bias of the coil spring 124 pulls the leg member 130 toward the leg bracket 110 and the locking tabs 128 again seat within the locking recesses 148 preventing the leg member 130 from rotating with respect to the leg bracket 110.

This processes is repeated for each of the rotatable leg assemblies 100. When all of the leg members 130 have been inverted with respect to the leg brackets 110, the game table 10 can be flipped or rotated about any longitudinal axis 50 or lateral axis 52 such as illustrated in FIG. 2 such that the leg members 130 again face down toward the support surface 13 and the opposite face of the game board 12 now faces up.

Referring to FIG. 3, the game table 10 includes a goal assembly 200 at each end of the game board. Each goal assembly 200 includes a goal base 202 having a slot 204 sized to receive an edge 206 of the game board 12 between cutout areas in the frame 14. The goal base 202 includes an upside 210 and a downside 212 with the upside 210 of one goal assembly positioned on the first side 20 of the game board 12 and the upside 210 of the other goal assembly positioned on the second side 30 of the game board 12. A different goal member 220 corresponding to the game playing surface 22, 32 is attached to the upside 210 of each goal base 202 so that when the first side 20 of the game board 12 is facing up, the goal member 220 corresponding to the first game playing surface 22 is facing up and when the second side 30 is facing up, the goal member 220 corresponding to the second game playing surface 32 is facing up. For example, for the football playing surface 20, the goal member 220 comprises a goal post 220-1 and for the basketball playing surface, the goal member 220 comprises a backboard and hoop.

The downside 212 of the goal base 202 may include a tray 214 for holding the game components of the game playing surface that is facing up. As best illustrated in FIGS. 1 and 2, the goal member 222 may be pivotally secured to the goal base and moveable between an upright position substantially perpendicular to the game board 12 to a storage position substantially parallel to the game board 12. For other games, such as hover hockey or shuffleboard, for example, the goal member 220 may be a slot or opening on the upside of the goal member 220 for which the leg members provide sufficient clearance and therefore there would be no need to have the goal member pivotable between an upright position and a storage position.

The goal assembly 200 may include a scorekeeper 224 such as a sliding marker alignable with numbers to keep track of a player's score during game play.

The foregoing description is presented to enable one of ordinary skill in the art to make and use the invention and is provided in the context of a patent application and its requirements. Various modifications to the preferred embodiment of the apparatus, and the general principles and features described herein will be readily apparent to those of skill in the art. Thus, the present invention is not to be limited to the embodiments of the apparatus described above and illustrated in the drawing figures, but is to be accorded the widest scope consistent with the spirit and scope of the appended claims.

The invention claimed is:

1. A two-sided table game, comprising:

a game board having at least four corners, and a first game playing surface on a first side of the game board and a second game playing surface on a second side of the game board; and a rotatable leg assembly disposed at each of the at least four corners of the game board thereby supporting the game board above a support surface in a first position with the first side facing up, each rotatable leg assembly having a fixed leg bracket and rotatable leg member, wherein the rotatable leg member is rotatable with respect to the fixed leg bracket from a first locked position to a second locked position, wherein in the first locked position, the rotatable leg member extends toward the support surface, and wherein in the second locked position, the rotatable leg member extends away from the support surface until the game board is flipped from the first position to a second position with the second side facing up.

2. The two-sided table game of claim 1 further comprising:

a goal assembly having a goal member movable from an upright playing position substantially perpendicular to the game board to a folded storage position substantially parallel to the game board.

3. The two-sided table game of claim 2 wherein the goal assembly includes a scorekeeper.

4. The two-sided table game of claim 2 wherein the goal assembly includes a tray for holding game components.

5. The two-sided table game of claim 1 further comprising:

a first goal assembly for the first game playing surface disposed on a first end of the game board, the first goal assembly having a goal member movable from an upright playing position substantially perpendicular to the first side to a folded storage position substantially parallel to the first side; and a second goal assembly for the second game playing surface disposed on a second end of the board, the second goal assembly having a goal member movable from an upright playing position substantially perpendicular to the second side to a folded storage position substantially parallel to the second side.

6. The two-sided table game of claim 5 wherein the first goal assembly includes a scorekeeper and the second goal assembly includes a scorekeeper.

7. The two-sided table game of claim 5 wherein the first goal assembly includes a tray for holding game components and the second goal assembly includes a tray for holding game components.

8. The two-sided table game of claim 1 wherein the first game playing surface is selected from a first group comprising football, basketball, soccer, hockey, table tennis, hover hockey, block hockey and shuffleboard and wherein the second game playing surface is selected from a second group comprising football, basketball, soccer, hockey, table tennis, hover hockey, block hockey and shuffleboard and wherein the second game playing surface selected from the second group is different from the first game playing surface selected from the first group.

9. The two-sided table game of claim 1 wherein the rotatable leg member is spring biased toward the leg bracket.

10. The two-sided table game of claim 1 wherein the leg bracket and rotatable leg member include mating tabs and recesses which seat together in the first locked position and in the second locked position preventing the leg member from rotating with respect to the leg bracket.

* * * * *